US008408829B2

(12) United States Patent
Kawaguchi et al.

(10) Patent No.: US 8,408,829 B2
(45) Date of Patent: Apr. 2, 2013

(54) RECORDING APPARATUS HAVING AN ADJUSTABLE RESTRAINING MEMBER

(75) Inventors: Koichiro Kawaguchi, Yokohama (JP); Kenji Kawazoe, Yokohama (JP); Haruo Uchida, Yokohama (JP); Nozomu Nishiberi, Yokohama (JP); Yoshiaki Watanabe, Tokyo (JP); Yasuyuki Asai, Tokyo (JP); Mitsuru Kondo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 563 days.

(21) Appl. No.: 12/107,707

(22) Filed: Apr. 22, 2008

(65) Prior Publication Data

US 2008/0265496 A1 Oct. 30, 2008

(30) Foreign Application Priority Data

Apr. 27, 2007 (JP) ..... 2007-118156

(51) Int. Cl.
*B41J 11/22* (2006.01)

(52) U.S. Cl. ..... 400/352; 400/527; 400/353; 400/633; 400/645; 347/198

(58) Field of Classification Search ..... 271/236, 271/238, 240, 250; 347/197, 101, 106, 198; 400/48, 353, 352, 527.1, 601, 633, 645.3, 400/645

See application file for complete search history.

(56) References Cited

U.S. PATENT DOCUMENTS

| | | | | |
|---|---|---|---|---|
| 5,065,169 | A * | 11/1991 | Vincent et al. | 347/8 |
| 5,301,938 | A * | 4/1994 | Casper | 271/245 |
| 5,368,403 | A * | 11/1994 | Broder et al. | 400/352 |
| 5,646,653 | A * | 7/1997 | Fujioka et al. | 347/8 |
| 5,937,260 | A * | 8/1999 | Taninaka et al. | 399/401 |
| 6,213,659 | B1 * | 4/2001 | Elgee | 400/633 |
| 6,742,948 | B2 * | 6/2004 | Feiner | 400/645 |
| 8,267,508 | B2 * | 9/2012 | Doo | 347/102 |
| 2005/0270352 | A1 * | 12/2005 | Iwase et al. | 347/104 |
| 2006/0170149 | A1 * | 8/2006 | Seto | 271/240 |

FOREIGN PATENT DOCUMENTS

| | | |
|---|---|---|
| JP | 2-209276 | 8/1990 |
| JP | 02-209276 A | 8/1990 |
| JP | 2-209277 | 8/1990 |
| JP | 2001-039580 A | 2/2001 |

* cited by examiner

*Primary Examiner* — Matthew G Marini
(74) *Attorney, Agent, or Firm* — Canon USA Inc IP Division

(57) ABSTRACT

A recording apparatus includes a platen that guides a sheet, restraining members disposed on the platen at respective side edges of the sheet to restrain the side edges of the sheet from being raised, a sheet width detector that detects the width of the sheet, and a restraining member detector that detects the positions of the restraining members. At least one of the restraining members is moved in accordance with the information obtained by the sheet width detector regarding the positions of the side edges of the sheet and the information obtained by the restraining position detector regarding the positions of the restraining members.

7 Claims, 14 Drawing Sheets

RECORDING APPARATUS HAVING AN ADJUSTABLE RESTRAINING MEMBER

BACKGROUND OF THE INVENTION

1. Field of the Invention

The present invention relates to a recording apparatus including a recording head that performs recording on a sheet conveyed to the recording head.

2. Description of the Related Art

Recording apparatuses include recording heads that record images on recording media conveyed thereto on the basis of image information. Sheet materials (hereinafter referred to simply as "sheets"), such as paper and plastic sheets, are used as the recording media. The recording apparatuses can be classified into inkjet recording apparatuses, wire dot recording apparatuses, thermal recording apparatuses, laser beam recording apparatuses, etc., depending on the recording methods thereof.

In a recording apparatus, if a sheet to be recorded on is curled, the sheet can come into contact with a recording head in a recording operation. If the sheet comes into contact with the recording head, there is a risk that a recorded image will be stained by ink or the like transferred to the sheet from the recording head. There is also a risk that the sheet will become jammed. The leading and trailing edges of the sheet are particularly easily curled and often causes the problem that the sheet comes into contact with the recording head or becomes jammed. Japanese Patent Laid-Open No. 2-209276 discusses a structure in which side edges of recording paper (sheet) are restrained by sheet-restraining plates while the recording paper is being conveyed. Japanese Patent Laid-Open No. 2-209277 discloses a structure in which the position of one of sheet-restraining plates is adjusted in accordance with the movement of a corresponding side guide included in a recording-sheet feeder.

However, in the known structures, if a user fails to accurately bring the side guide into contact with a side edge of the recording sheet, there is a possibility that the sheet-restraining member cannot be placed at a position corresponding to the side edge of the recording sheet. As a result, the sheet-restraining member cannot serve its purpose and there is a risk that the sheet will come into contact with the recording head or become jammed. In addition, if the recording apparatus has a plurality of sheet feeding mechanisms disposed in a rear section, a bottom section, etc., of the main body of the apparatus, it is difficult to adjust the position of the sheet-restraining member in accordance with the positions of side guides included in the sheet feeding mechanisms. Therefore, if sheets with different widths are set in the sheet feeding mechanisms, the sheets cannot be reliably prevented from coming into contact with the recording head or becoming jammed. In addition, also when a single sheet feeding mechanism is used, similar problems occur if the sheets with different widths are stacked in the sheet feeding mechanism.

SUMMARY OF THE INVENTION

The present invention is directed to a recording apparatus capable of preventing a recording sheet from coming into contact with a recording head or becoming jammed irrespective of the state in which the recording sheet is set in a sheet-feeding unit.

According to an aspect of the present invention, provided is a recording head that performs recording on a sheet using a recording head and that includes a guide member configured to guide the sheet at a position where the guide member faces the recording head; a restraining member arranged on the guide member and configured to restrain a side edge of the sheet from being raised; a sheet width detector configured to detect a width of the sheet that is conveyed; and a restraining position detector configured to detect a position of the restraining member. The restraining member is moved in accordance with a position of the side edge of the sheet and the position of the restraining member, the position of the side edge of the sheet being detected by the sheet width detector and the position of the restraining member being detected by the restraining position detector.

Further features of the present invention will become apparent from the following description of exemplary embodiments with reference to the attached drawings.

DESCRIPTION OF THE EMBODIMENTS

Figure 1:
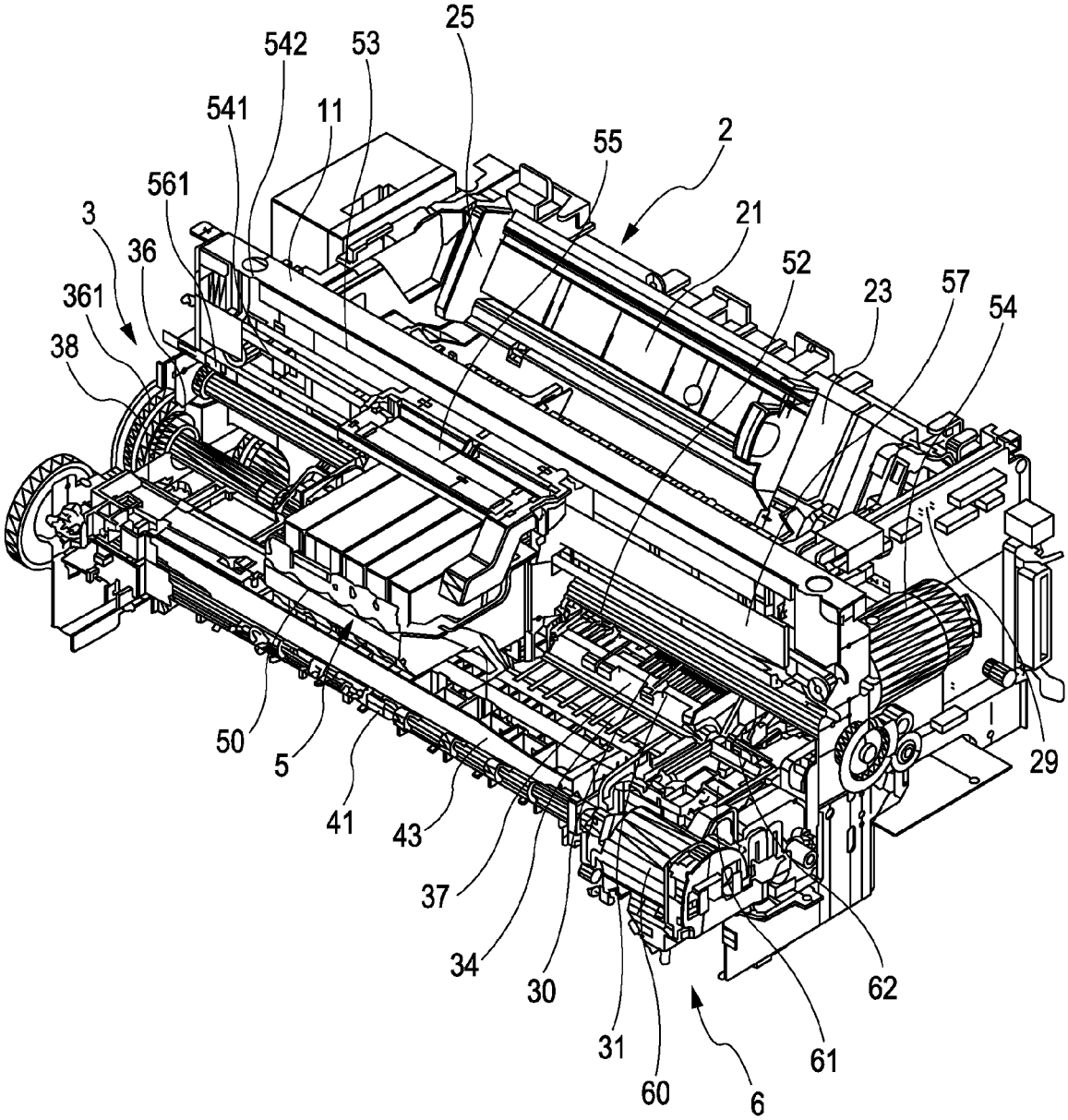
FIG. 1 is a right front perspective view of a recording apparatus according to an embodiment of the present invention.
Figure 2:
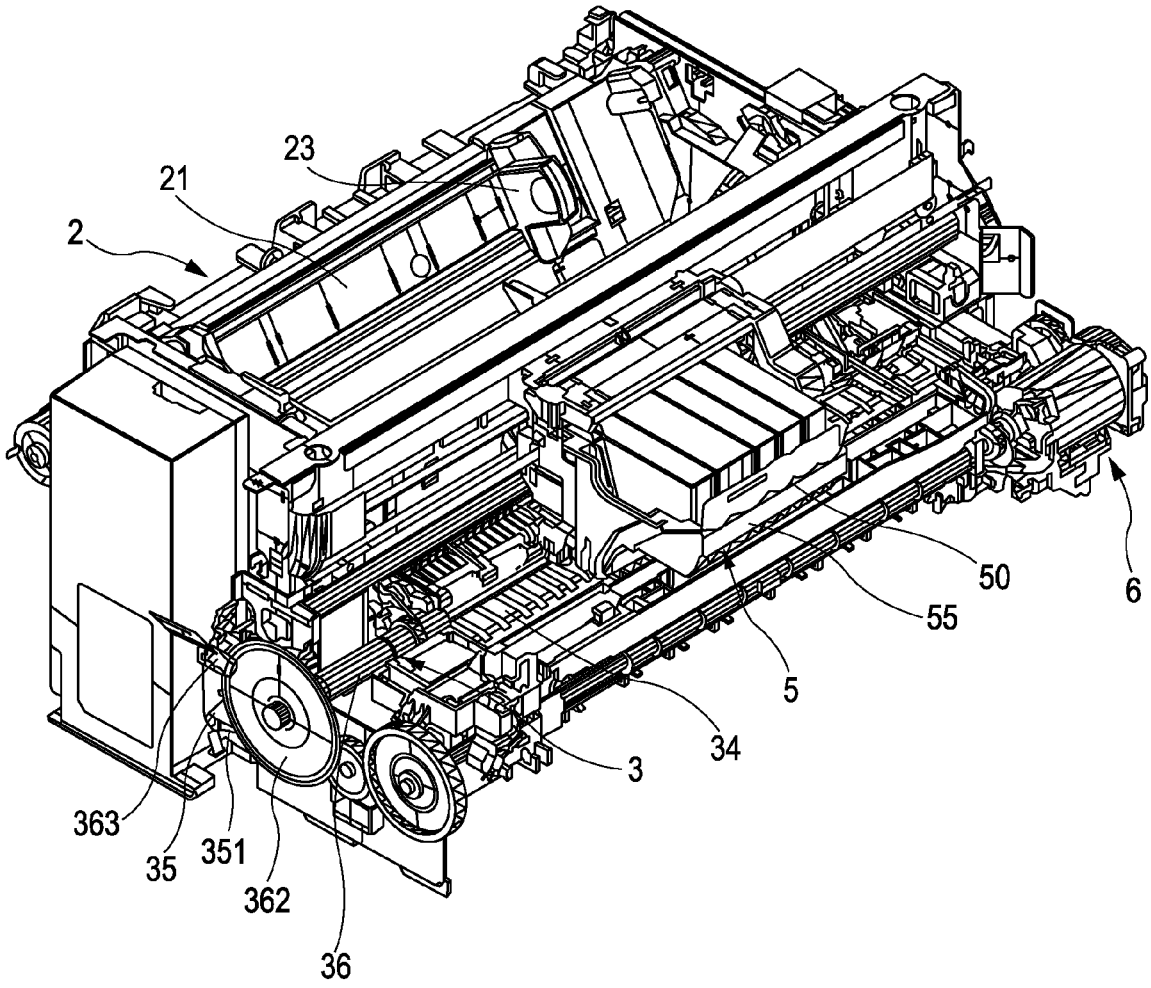
FIG. 2 is a left front perspective view of the recording apparatus shown in FIG. 1.
Figure 3:
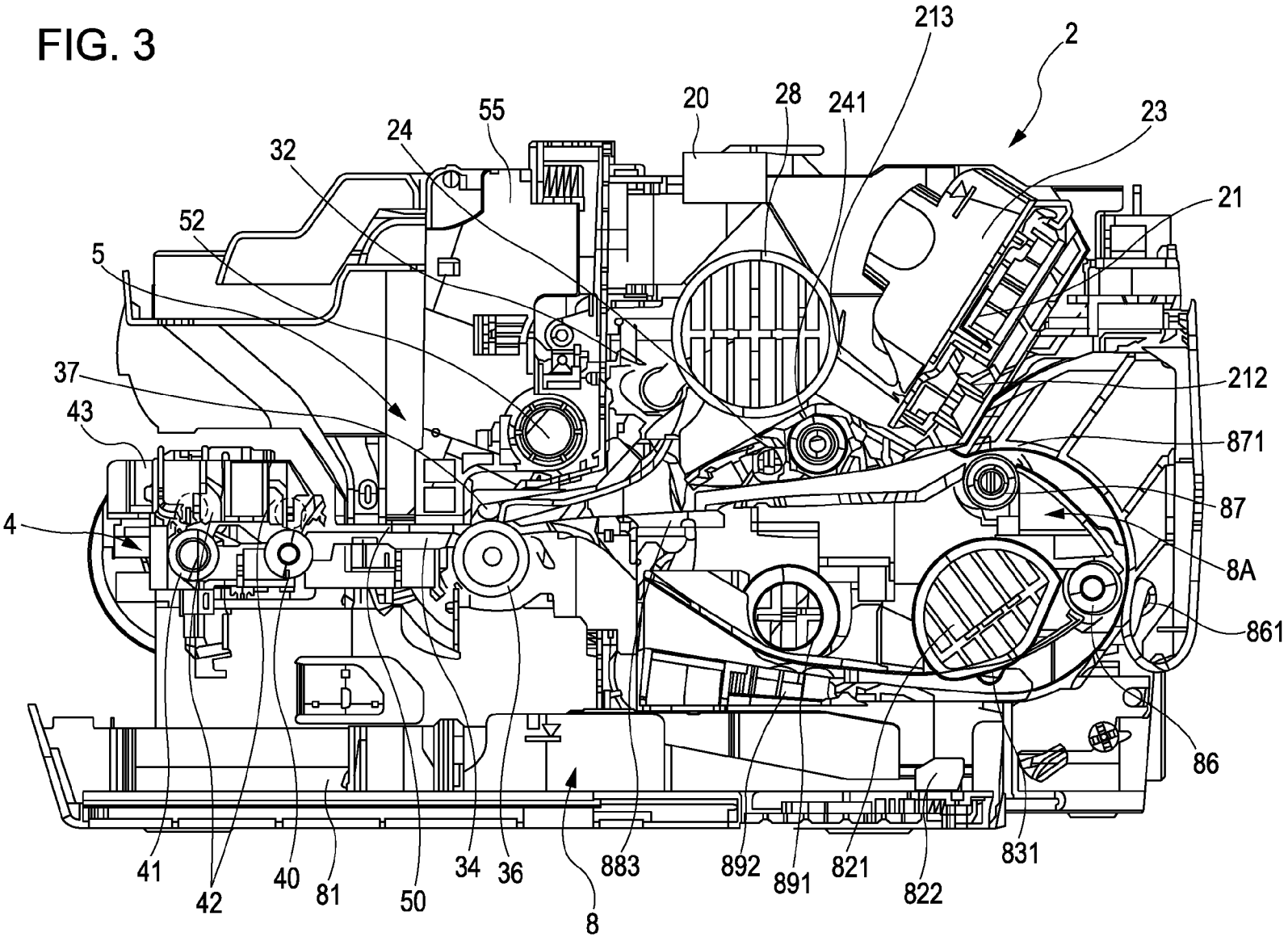
FIG. 3 is a vertical sectional view of the recording apparatus shown in FIG. 1.

Embodiments of the present invention will be described below with reference to the accompanying drawings. In the drawings, the same or similar components are denoted by the same reference numerals. FIG. 1 is a right front perspective view of a recording apparatus according to an embodiment of the present invention. FIG. 2 is a left front perspective view of the recording apparatus shown in FIG. 1. FIG. 3 is a vertical sectional view of the recording apparatus shown in FIG. 1. The recording apparatus shown in FIGS. 1 to 3 is an inkjet recording apparatus. The recording apparatus includes a first sheet-feeding unit 2, a conveying unit 3, a recording unit 5, a recovery process unit 6, and a second sheet-feeding unit (a U-turn sheet-feeding unit) 8. The recording apparatus also includes exterior units (not shown) on which a retractable paper feed tray and a sheet output tray are provided.

The first sheet-feeding unit 2 includes a pressure plate 21 on which sheets, which function as recording media, are stacked, a feed roller 28 for feeding each sheet, a separation roller 241 for separating the sheets from each other, and a base 20 to which the pressure plate 21, the feed roller 28, and the separation roller 241 are attached. The sheets stacked on the pressure plate 21 are held by the retractable paper feed tray provided on the exterior unit disposed on the back side of the apparatus body. The pressure plate 21 has a movable side guide 23 that is attached thereto in a slidable manner so that the position at which the sheets are stacked can be regulated by the side guide 23. The pressure plate 21 also has a reference sheet guide 25 at the side opposite to the side guide 23. The pressure plate 21 is pivotable about a shaft provided on the base 20, and is urged toward the feed roller 28 by a pressure-plate spring 212. A separation sheet 213 for preventing double feeding of the sheets is provided on a portion of the pressure plate 21 that faces the feed roller 28. The separation sheet 213 is made of a material having a large coefficient of friction. The pressure plate 21 is brought into contact with and separated from the feed roller 28 at predetermined timing by a pressure plate cam (not shown).

The separation roller 241 for separating the sheets from each other is rotatably supported by a separation roller holder 24 attached to the base 20. The separation roller holder 24 is urged by a spring so that the separation roller 241 is urged toward the feed roller 28. The separation roller 241 has a torque limiter connected thereto, and is rotated when a torque that is equal to or higher than a predetermined value is applied. The separation roller 241 can be brought into contact with and separated from the feed roller 28. The positions of the pressure plate 21, the separation roller 241, etc. are detected by an automatic sheet feeder (ASF) sensor 29.

The conveying unit 3 includes a conveying roller 36 for conveying the sheets and a paper end (PE) sensor 32. The conveying roller 36 is obtained by coating the surface of a metal shaft with fine ceramic particles, and is supported by bearings 38 provided on a chassis 11 at the ends of the metal shaft. A plurality of pinch rollers 37 are in pressure contact with the peripheral surface of the conveying roller 36. The pinch rollers 37 are held by a pinch roller holder 30 and are pressed against the conveying roller 36 by pinch roller springs 31, thereby generating a conveying force.

A pulley 361 is provided on the shaft of the conveying roller 36. The conveying roller 36 is driven by transmitting the rotation of a conveying motor 35 to the pulley 361 via a timing belt 351. A code wheel 362 used to detect the amount of conveyance is provided on the shaft of the conveying roller 36. The amount of conveyance is detected by reading marks on the code wheel 362 with an encoder sensor 363.

The recording unit 5 will now be described. The recording unit 5 includes a platen 34 that functions as a member for supporting and guiding a sheet that is being conveyed. The recording unit 5 also includes a recording head 50 that forms an image on the sheet supported on a conveyance surface of the platen 34. The recording head 50 is mounted on a carriage 55 that can be moved in a reciprocating manner. The recording head 50 includes an ink discharging unit having a plurality of discharge ports for discharging ink droplets in accordance with image information. An example of the ink discharging unit uses an electrothermal conversion method in which ink contained inside the discharge ports is heated by heaters so that film boiling of the ink is caused by thermal energy. Bubbles of ink vapor are generated as a result of film boiling of the ink, and ink droplets are discharged from the discharge ports in the recording head 50 in accordance with pressure variation that occurs as the bubbles expand and contract. An image is recorded on the sheet by selectively discharging the ink droplets from the discharge ports.

The carriage 55 is supported and guided such that the carriage 55 can reciprocate in the left-right direction along a guide shaft 52 and a guide rail 53. The guide shaft 52 is attached to the chassis 11, and the guide rail 53 is formed integrally with the chassis 11. The carriage 55 is driven by a carriage motor 54 using a timing belt 541 stretched between the carriage 55 and an idle pulley 542. A code strip 561 is disposed parallel to the guide shaft 52. The carriage 55 has an encoder sensor (not shown) that reads marks on the code strip 561, and thus the position and velocity of the carriage 55 can be detected. The carriage 55 is connected to a flexible board 57 for transmitting a head signal to the recording head 50.

The guide shaft 52 has eccentric cams (not shown) at the ends thereof. The rotation of, for example, a control cam included in the recovery process unit 6, which will be described below, is transmitted to the eccentric cams through a gear train, so that the eccentric cams are rotated to move the guide shaft 52 in the vertical direction. Thus, the carriage 55 can be moved in the vertical direction so as to control the distance from the discharge ports in the recording head 50 to the surface of the sheet at an optimum distance irrespective of the thickness of the sheet. The carriage 55 is also moved in the vertical direction to prevent the sheet from coming into contact with the recording head 50 when the sheet is partially raised or deformed. In the recording unit 5, the recording head 50 performs recording on the sheet that is conveyed along the top surface of the platen 34, which functions as a guiding member, by the conveying roller 36 and the pinch rollers 37. More specifically, the sheet is stopped after being conveyed by a predetermined pitch, and then the recording head 50 on the carriage 55 records an image corresponding to a single line in a main-scanning direction. Recording of an image corresponding to a single line and conveyance of the sheet are alternately repeated until the entire area of the sheet is recorded on.

A paper ejection unit positioned downstream of the recording unit 5 in a sheet conveying direction in which the sheet is conveyed will now be described. In the present embodiment, first and second paper ejection rollers 40 and 41 are disposed downstream of the recording unit 5 in the sheet conveying direction. The first sheet ejecting roller 40 is driven by the rotation of the conveying roller 36 transmitted through a gear train or the like, and the second sheet ejecting roller 41 is driven by the rotation of the first sheet ejecting roller 40. The sheet ejecting rollers 40 and 41 are in pressure contact with respective spur rollers 42. The sheet ejecting rollers 40 and 41 are attached to the platen 34. Each spur roller 42 is obtained by integrating a thin plate which is made of stainless steel or the like and which has projections on the peripheral surface thereof with a resin portion. The spur rollers 42 are rotatably supported on a spur-roller holder 43 by shafts made of coil springs. The spur rollers 42 are pressed against the sheet ejecting rollers 40 and 41 by an urging force applied by the coil springs. The sheet on which an image is recorded is ejected from the apparatus body by the sheet ejecting rollers 40 and 41 and the spur rollers 42 and is placed on the sheet output tray (not shown) or the like.

The inkjet recording apparatus includes the recovery process unit 6 for preventing clogging of the discharge ports in the recording head 50 and for maintaining and recovering the ink discharge performance of the recording head 50. The recovery process unit 6 includes a suction pump 60, a cap 61, and a wiper 62. The cap 61 covers the discharge ports in the recording head 50 to prevent the ink from drying and dust and the like from adhering to the discharge ports. The suction pump 60 is connected to the cap 61 and operates while the discharge ports are sealed by the cap 61, thereby sucking ink out of the discharge ports and allowing fresh ink to fill the discharge ports. The wiper 62 wipes a discharge surface of the recording head 50 so as to clean the discharge surface. The suction pump 60 can be a tube pump in which a tube connected to the cap 61 is squeezed so that a negative pressure is generated in the tube and the thus generated negative pressure is applied to the discharge ports.

The U-turn sheet-feeding unit 8, which functions as the second sheet-feeding unit, and a U-turn conveying unit 8A for conveying the sheet from the sheet-feeding unit 8 and for performing both-side recording will now be described. The U-turn conveying unit 8A has a U-turn conveying path used in the operation of underprinting and both-side printing. The U-turn sheet-feeding unit 8 is disposed in a lower section of the apparatus body and has a sheet-feeding cassette 81 disposed in a bottom front section of the apparatus body. The sheets stacked in the sheet-feeding cassette 81 are conveyed along the U-turn conveying path such that the sheets are reversed before reaching the recording unit 5.

The sheet-feeding cassette 81 has a pressure plate 822 arranged to press the stack of sheets contained in the sheet-feeding cassette 81 against a feed roller 821. The feed roller 821 operates together with a separation roller 831 and a separation sheet so that the top sheet of the stack is separated from the other sheets and fed to the U-turn conveying path. The thus separated sheet is conveyed toward the recording unit 5 by first and second intermediate rollers 86 and 87 disposed at different positions along the U-turn conveying path and pinch rollers 861 and 871 that are in pressure contact with the intermediate rollers 86 and 87, respectively. A switch flapper 883 is disposed at the junction of a conveying path of the first sheet-feeding unit 2 and the conveying path of the U-turn conveying unit 8A. The sheet from the U-turn conveying unit 8A is conveyed to a nip section between the conveying roller 36 and the pinch rollers 37 through the flapper 883. Then, an image is recorded on the sheet while the sheet is conveyed on the platen 34 by the conveying roller 36.

The operation of both-side recording using the U-turn conveying unit 8A will be described below. The sheet fed from the first sheet-feeding unit 2 or the second sheet-feeding unit 8 is conveyed on the platen 34 by the conveying roller 36 while an image is recorded on a first side of the sheet by the recording head 50. The first side is the side on which an image is recorded first. In single-sided printing, the sheet is directly ejected from the apparatus body by the sheet ejecting rollers 40 and 41 after the first side is recorded on. In both-side recording, the switch flapper 883 is switched to the U-turn conveying path and the conveying roller 36 is driven in the reverse direction after the first side is recorded on.

Then, the sheet on which an image is recorded at the first side thereof is conveyed to the U-turn conveying unit 8A. The sheet conveyed to the U-turn conveying unit is fed to a nip section between a both-side recording roller 891 and pinch rollers 892. The both-side recording roller 891 is positioned upstream of the feed roller 821. The sheet is conveyed by the both-side recording roller 891 and the pinch rollers 892 to the U-turn conveying path along which the first and second intermediate rollers 86 and 87 are arranged. Then, the sheet is reversed by the first and second intermediate rollers 86 and 87 and is conveyed to the conveying roller 36 again. At this time, the switch flapper 883 is returned to the position at which the switch flapper 883 was placed when the first side was recorded on. The sheet is conveyed by the forward rotation of the conveying roller 36 while an image is recorded on the second side of the sheet by the recording head 50. After the image is recorded on the second side, the sheet is ejected from the apparatus body by the ejecting rollers 40 and 41.

Figure 4:
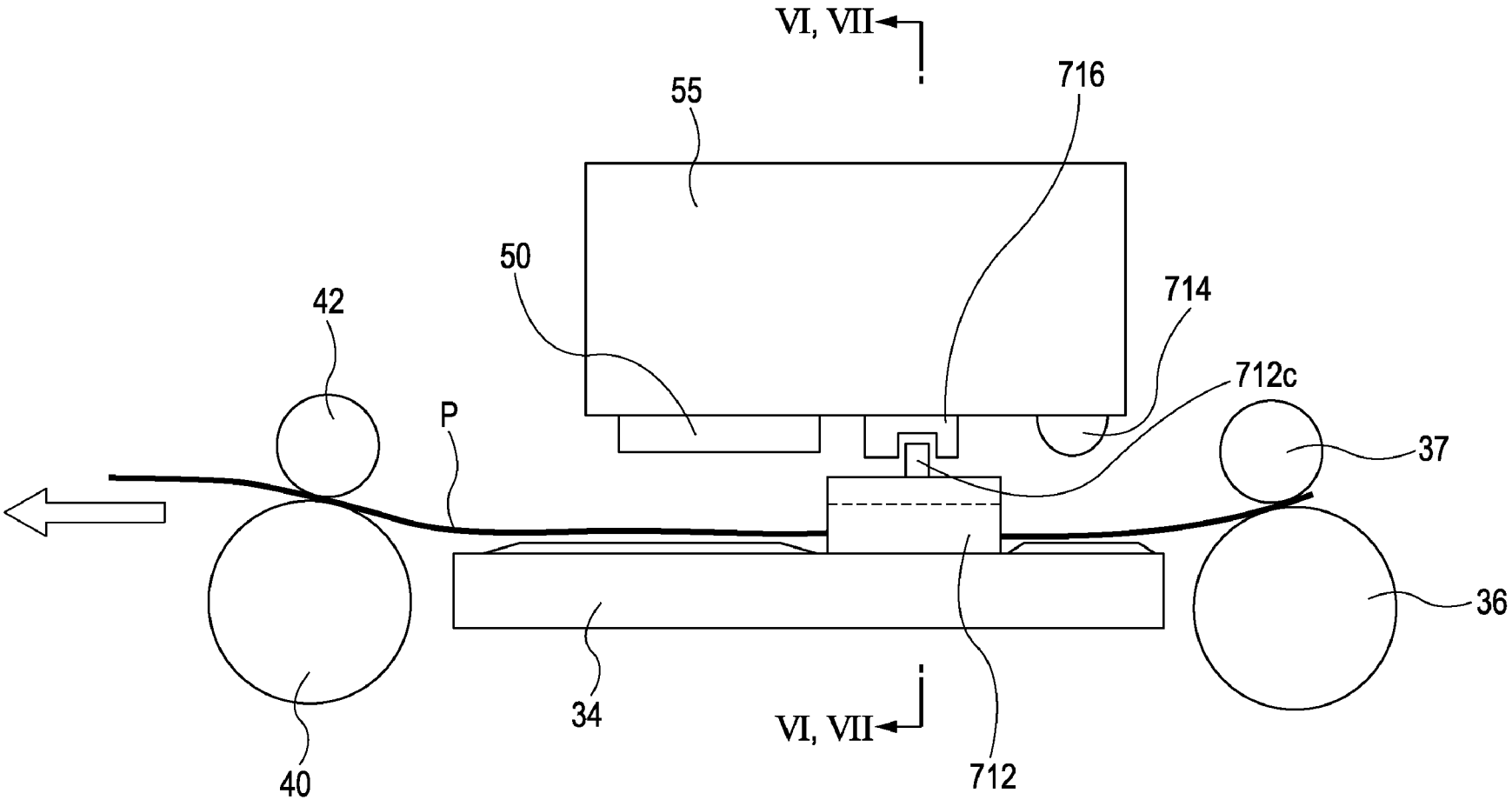
FIG. 4 is a side view of a sheet-edge restraining unit.
Figure 5:
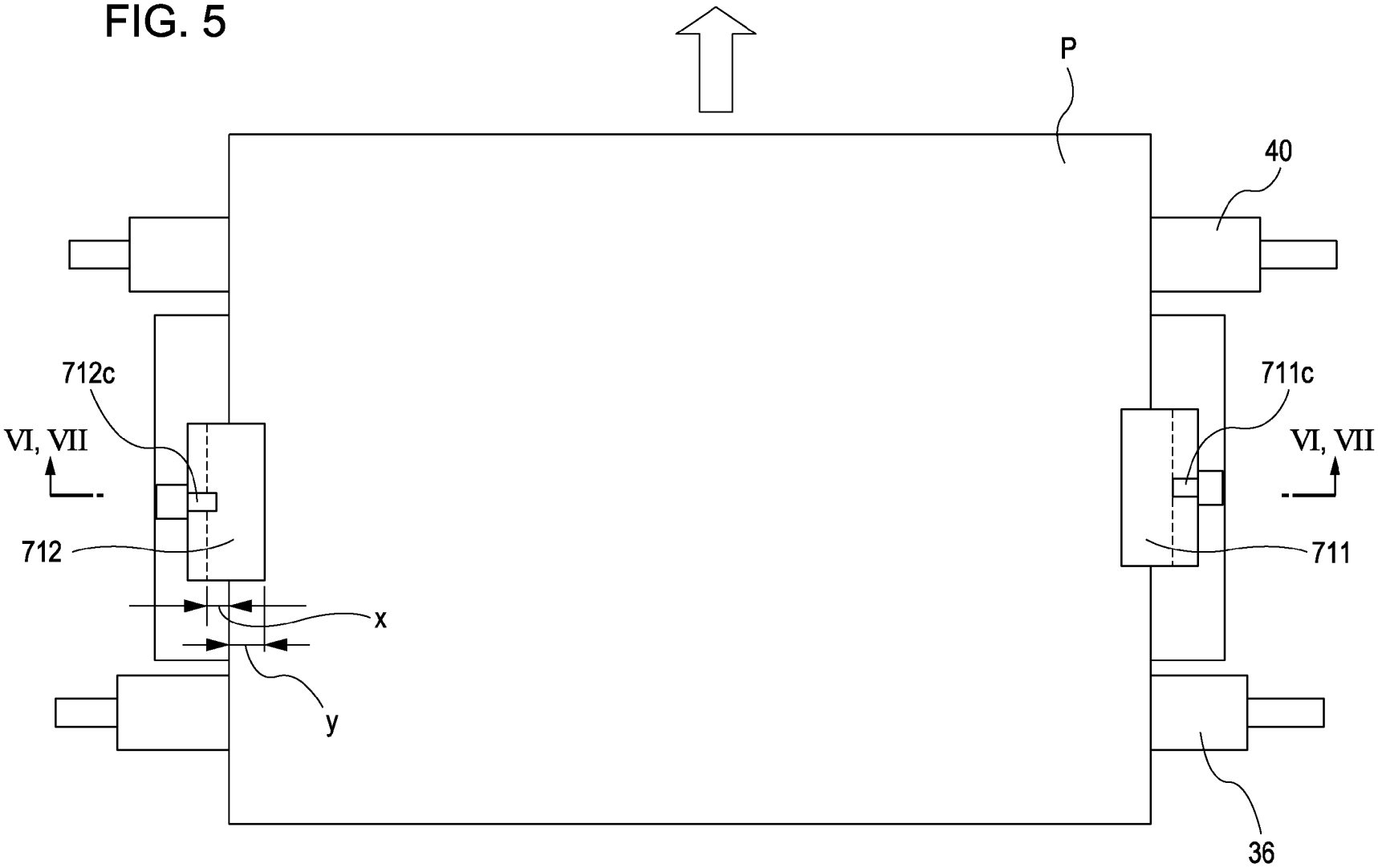
FIG. 5 is a plan view of the sheet-edge restraining unit shown in FIG. 4.

FIG. 4 is a side view of a restraining unit for preventing the sheet from being raised at side edges thereof. FIG. 5 is a plan view of the restraining unit shown in FIG. 4. Referring to FIGS. 4 and 5, first and second restraining members 711 and 712 for preventing the sheet P from being raised at side edges thereof are attached to the platen 34 that is disposed so as to face the recording head 50 mounted on the carriage 55. At least one of the restraining members 711 and 712 is movable (the position thereof is adjustable) in the sheet-width direction. In the present embodiment, the first restraining member 711 at the reference side for positioning the sheet (right side in FIG. 5) is fixed, and the second restraining member 712 at the side opposite to the reference side (left side in FIG. 5) is movable in the sheet-width direction.

In the known structure, the position of the restraining member disposed at the side opposite to the reference side and used to prevent the sheet from being raised in a region where the sheet faces the recording head is adjusted in the following manner. That is, the position of the restraining member is adjusted in accordance with the position of the side guide (corresponding to the movable side guide 23 in the present embodiment) for guiding the sheet in the width direction when the sheet is set in the sheet-feeding unit. However, in the known structure, if a user fails to accurately set the side guide at the side edge of the sheet or forgets to set the side guide, the restraining member cannot be moved to a suitable position. As a result, there is a possibility that the sheet will come into contact with the recording head or become jammed. In addition, in the known structure, if sheets having different widths are set in a plurality of sheet-feeding units, the restraining member can only be moved to a position corresponding to one of the sheet widths. Therefore, if, for example, the restraining member is positioned inside the side edge of the sheet being conveyed, the sheet will come into contact with the restraining member and become jammed. The recording operation can be stopped and a warning can be issued if the position of the restraining member does not match the sheet size information transmitted to the recording apparatus from a printer driver or the like. However, also in this case, the above-described problem can occur if the user does not select accurate sheet size information through the printer driver or the like.

Sheets of various sizes can be used in the recording apparatus. Therefore, the second restraining member 712 must be movable to positions corresponding to the sheet widths. Referring to FIGS. 4 and 5, the carriage 55 on which the recording head 50 is mounted and which reciprocates in the sheet-width direction has a sheet-width detection sensor 714. The sheet-width detection sensor 714 detects the side edges of the sheet P using the movement of the carriage 55, thereby determining the sheet width. When the leading edge of the sheet P reaches the position corresponding to the sheet-width detection sensor 714, the sheet is stopped and movement of the second restraining member 712 is started. The carriage 55 also has a restraining-member detection sensor 716 for detecting the positions of the first restraining member 711 and the second restraining member 712. The restraining-member detection sensor 716 detects detection bars 711*c* and 712*c* provided on the restraining members 711 and 712, respectively, thereby determining the positions of the restraining members 711 and 712. In the present embodiment, as shown in FIG. 4, the sheet-width detection sensor 714 that functions a sheet width detector, the restraining members 711 and 712, and the recording head 50 are arranged in that order from the upstream side in the sheet-conveying direction.

Figure 6:
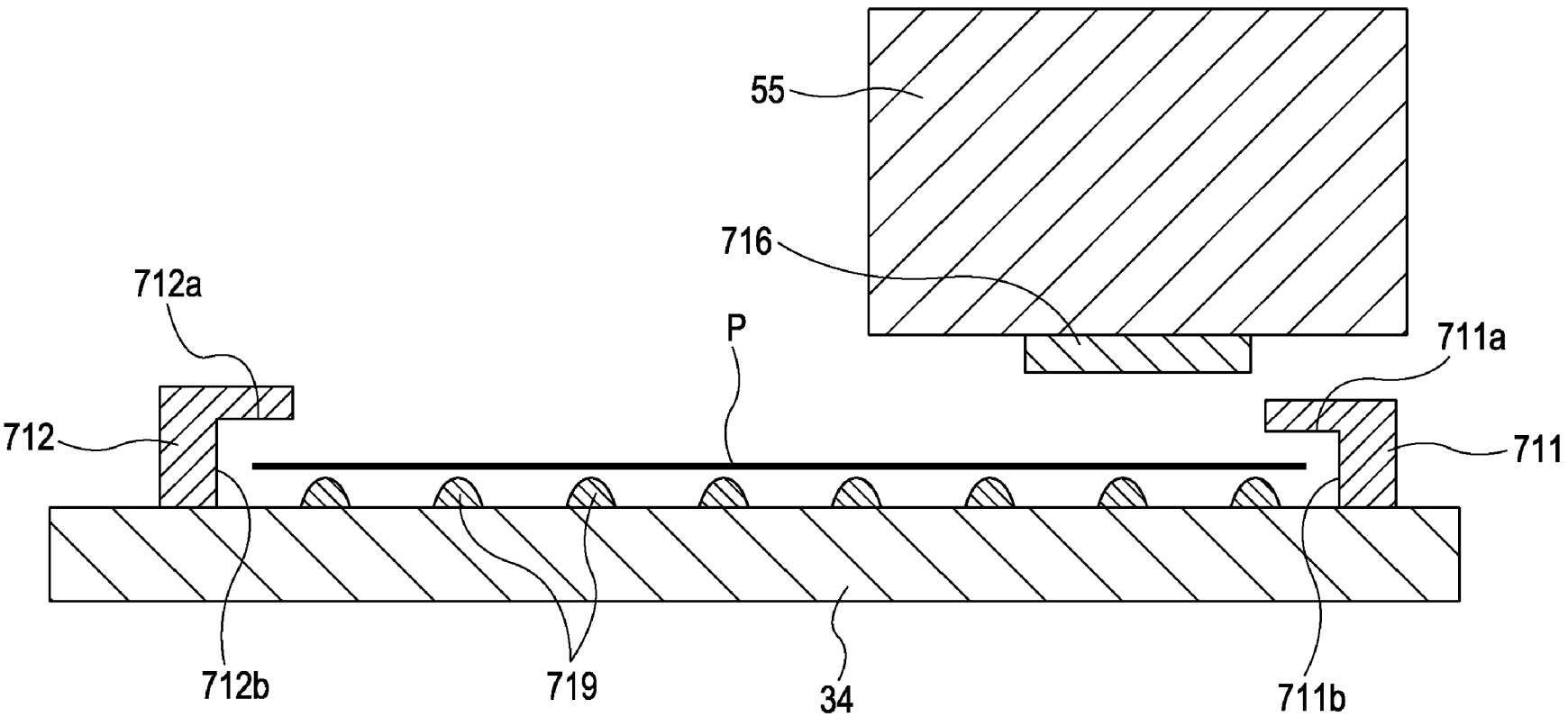
FIG. 6 is a sectional view of FIG. 4 taken along line VI-VI in the state in which the sheet is not raised at side edges thereof.
Figure 7:
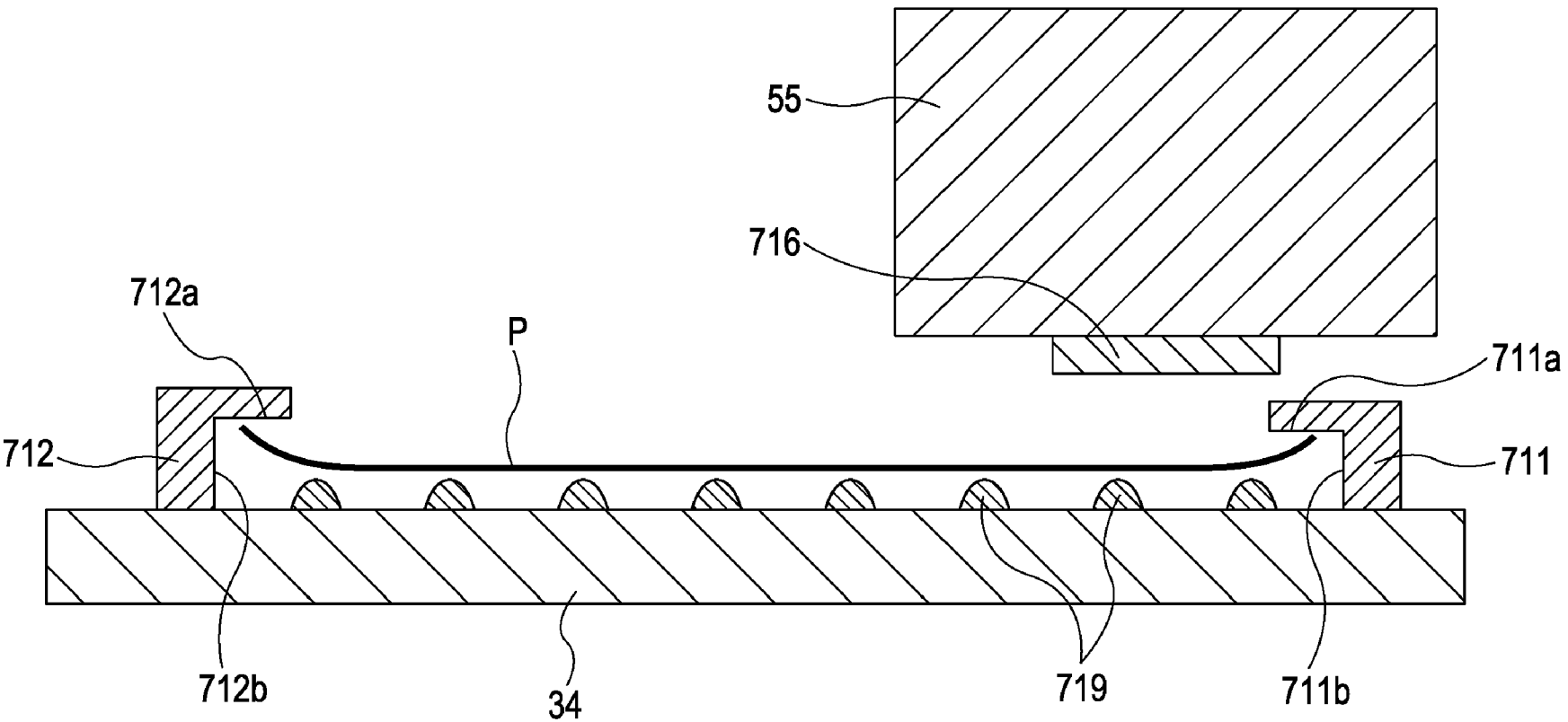
FIG. 7 is a sectional view of FIG. 4 taken along line VII-VII in the state in which the sheet is raised at side edges thereof.

FIG. 6 and 7 are sectional views of FIG. 4 taken along line VI, VII-VI, VII. FIG. 6 illustrates the case in which the sheet P is not raised at the side edges thereof, and FIG. 7 illustrates the case in which the sheet P is raised at the side edges thereof. In the present embodiment, the first restraining member 711 and the second restraining member 712 are attached to the platen 34. The first restraining member 711 is fixed to the platen 34, and the second restraining member 712 is attached such that the second restraining member 712 is movable relative to the platen 34 in the sheet-width direction. The restraining members 711 and 712 are positioned and shaped such that the restraining members 711 and 712 do not come into contact with the sheet P if the sheet P is not curled, as shown in FIG. 6. Therefore, in this state, the restraining members 711 and 712 apply no load to the sheet P in the process of conveying the sheet P.

A plurality of ribs 719 that extend in the sheet conveying direction are arranged on the platen 34. The ribs 719 guide the bottom surface of the sheet so that a suitable gap can be provided between the recording head 50 and the sheet. As an example, in the present embodiment, the gap S between the recording head 50 and the ribs 719 on the platen 34 is set to 1.2 mm, the thickness t of the sheet P is set to 0.1 mm to 0.3 mm, and the distance U from restraining surfaces 711*a* and 712*a* of the restraining members 711 and 712, respectively, to the ribs 719 is set to 0.6 mm. Therefore, the sheet does not come into contact with the restraining members 711 and 712 unless the amount of curl of the sheet is about 0.3 mm to 0.5 mm or more. The sheet can be effectively restrained by the restraining members 711 and 712 if the amount of curl of the sheet is about 0.3 mm to 0.5 mm or more. The side edges of the sheet P are spaced from upright wall portions 711*b* and 712*b* of the restraining members 711 and 712, respectively, by distances in such a range that the restraining performance can be maintained. The restraining members 711 and 712 can be made of, for example, stainless steel plates with a thickness of about 0.2 mm.

Figure 8:
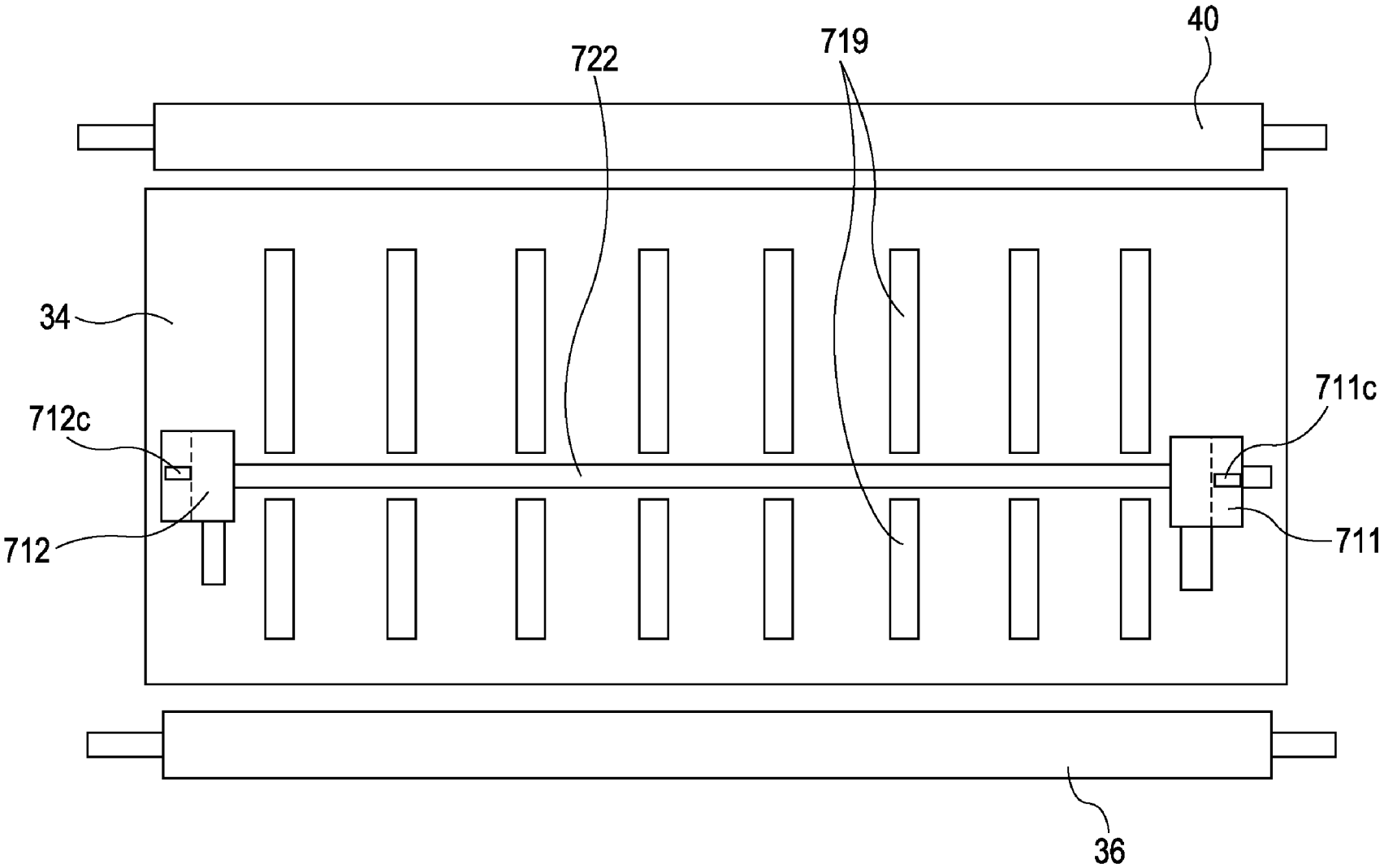
FIG. 8 is a plan view illustrating the positions at which restraining members are placed in the process of recording on a large sheet.
Figure 9:
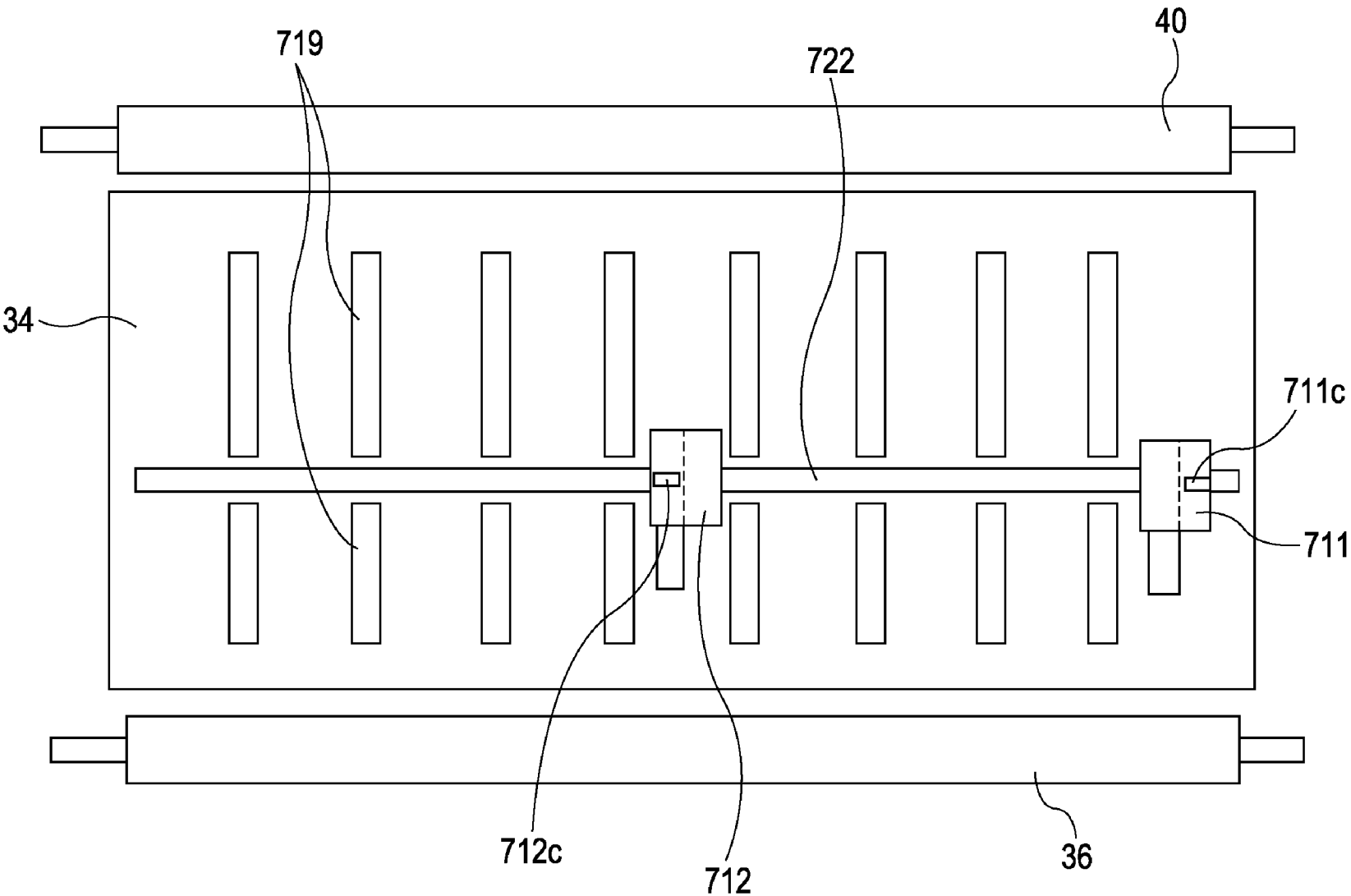
FIG. 9 is a plan view illustrating the positions at which restraining members are placed in the process of recording on a small sheet.

FIGS. 8 and 9 are plan views illustrating the manner in which the second restraining member 712 is moved. FIG. 8 shows the position of the second restraining member 712 in the process of recording on a large sheet. FIG. 9 shows the position of the second restraining member 712 in the process of recording on a small sheet. Referring to FIGS. 8 and 9, the second restraining member 712 is movable in the sheet-width direction along a guide rail 722 provided on the platen 34. The second restraining member 712 is moved by a drive source (not shown) as necessary.

Figure 10:
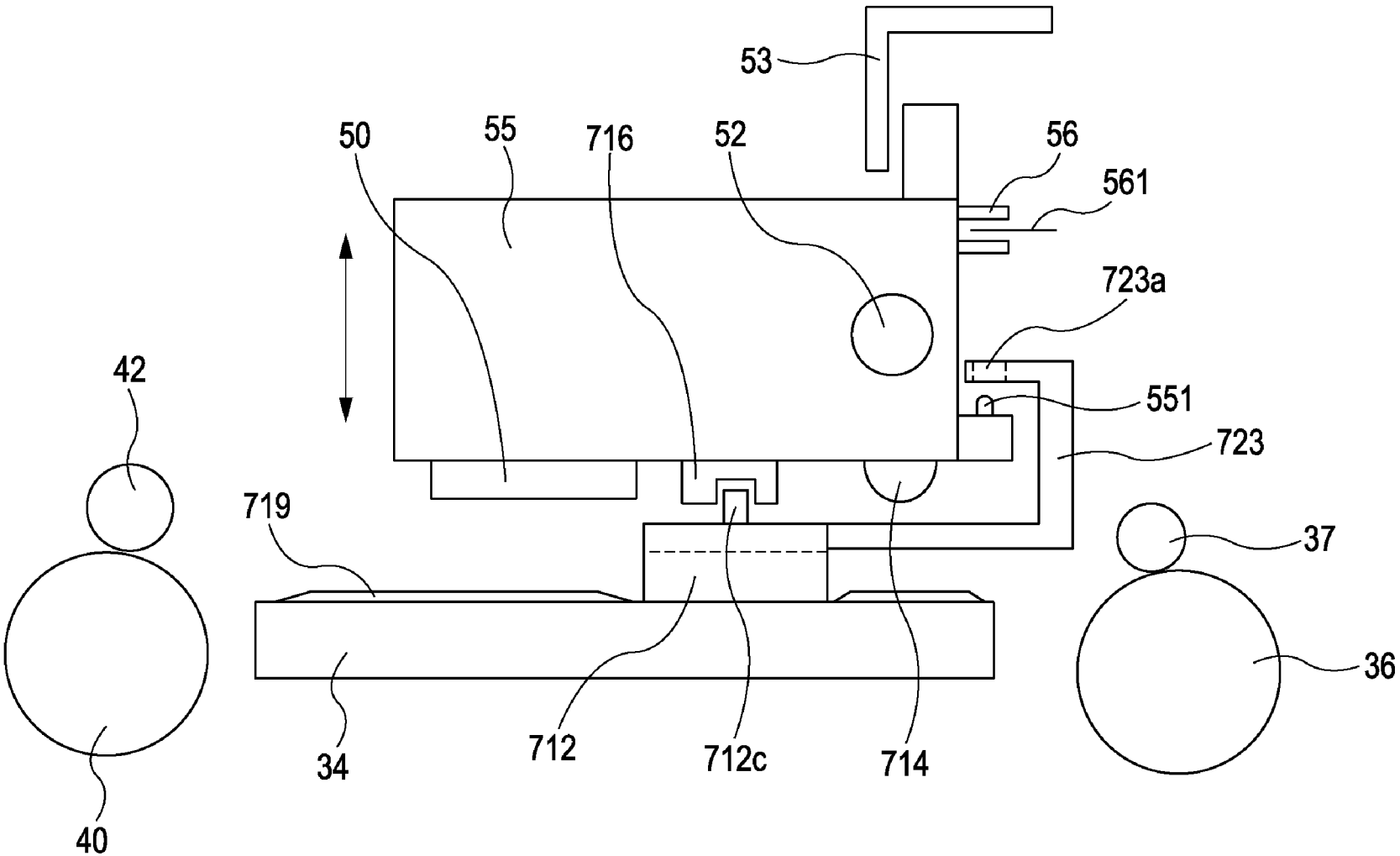
FIG. 10 is a side view of a sheet width detection sensor and a restraining position detection sensor.

The second restraining member 712 can be moved by a dedicated drive source using a rack-and-pinion mechanism or the like. However, in the present embodiment, the second restraining member 712 is moved using the carriage motor 54. FIG. 10 is a side view of a movement control unit for moving the second restraining member 712 to a position adequate for restraining the corresponding side edge of the sheet. As shown in FIG. 10, the second restraining member 712 has an arm unit 723 that extends from the main body of the second restraining member 712. The arm unit 723 has a fitting hole 723*a* at a distal end thereof. The carriage 55 has a boss 551 that can be fitted into the hole 723*a*. The fitting hole 723*a* and the boss 551 form a connecting unit that connects the second restraining member 712 and the carriage 55 to each other. During the recording operation, the boss 551 and the hole 723*a* are separated from each other, as shown in FIG. 10, so that the connection between the second restraining member 712 and the carriage 55 is canceled.

In the process of moving the second restraining member 712, first, the carriage 55 is moved upward at the position where the second restraining member 712 is detected by the restraining-member detection sensor 716. Thus, the boss 551 is fitted into the hole 723*a*. As a result, the carriage 55 and the restraining member 712 are connected to each other and become capable of moving together. The carriage 55 is moved in the vertical direction by controlling the rotational position of the eccentric cams at the ends of the guide shaft 52 by a motor (not shown). The positions of the side edges of the sheet are detected by the sheet-width detection sensor 714 using the movement of the carriage 55. The second pressing member 712 is moved in accordance with the information obtained by the sheet-width detection sensor 714 regarding the position of the corresponding side edge of the sheet and the information obtained by the pressing-member detection sensor 716 regarding the position of the restraining member 712. The second restraining member 712 is controlled so as to automatically move to a position suitable for restraining the sheet from being raised at the corresponding side edge thereof. After the second restraining member 712 is moved, the carriage 55 is moved downward so that the second restraining member 712 is released from the carriage 55. Thus, the state in which recording can be performed is reestablished. In the above-described control operation, the position of the carriage 55 in the sheet-width direction is determined by reading the marks on the code strip 561 with the encoder sensor 56 mounted on the carriage 55.

Figure 11:
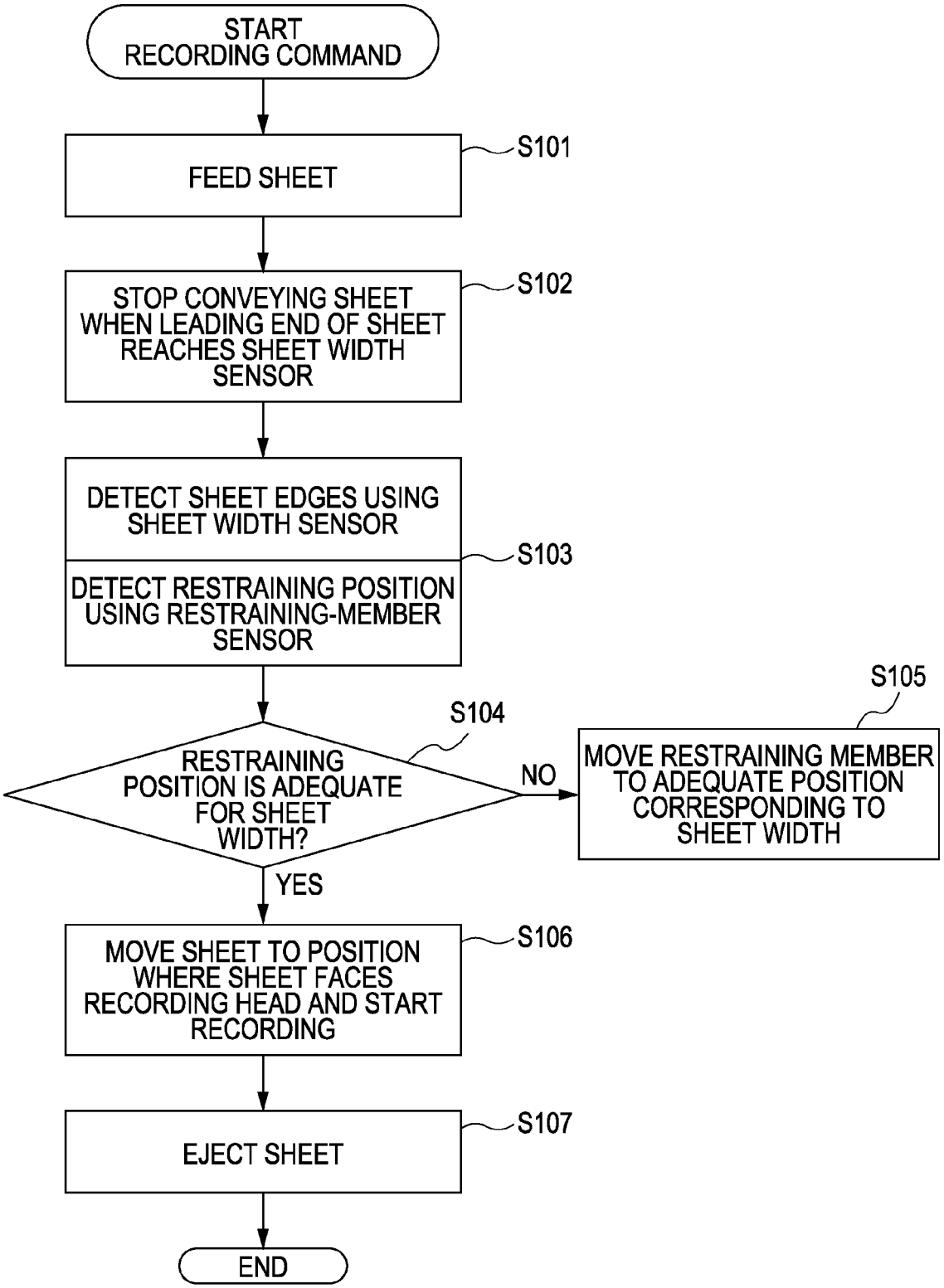
FIG. 11 is a flowchart of the operation of the recording apparatus.

FIG. 11 is a flowchart of an example of the operation of the recording apparatus according to the present embodiment. When a recording command is issued, an operation of feeding the sheet from the sheet-feeding unit is started in step S101. Then, in step S102, the sheet P is conveyed to the recording unit 5 and is stopped when the leading edge of the sheet P reaches the position where the leading edge of the sheet P faces the sheet-width detection sensor 714. In step S103, the side edges of the sheet P are detected by the sheet-width detection sensor 714 by moving the carriage 55 in the sheet-width direction while the sheet P is stationary. Thus, the information regarding the position of the side edges of the sheet is obtained. At the same time, the positions of the restraining members 711 and 712 are detected by the restraining-member detection sensor 716 provided on the carriage 55. Thus, the information regarding the current restraining positions is obtained.

Then, the detected positions of the side edges of the sheet are compared with the detected positions of the restraining members 711 and 712 in step S104, and the second restraining member 712 is moved on the basis of the result of the comparison to a position suitable for restraining the corresponding side edge of the sheet in step S105. In the present embodiment, the second restraining member 712 is moved to a position where the distance x from the upright wall portions 711*b* and 712*b* of the restraining members 711 and 712, respectively, to the respective side edges of the sheet is about 2 mm and the distance y by which the restraining surfaces 711*a* and 712*a* of the restraining members 711 and 712, respectively, overlap the respective side edges of the sheet is about 2 mm. The distances x and y are not limited to the above-mentioned values as long as the upright wall portions 711*b* and 712*b* do not come into contact with the respective side edges of the sheet and the areas in which the sheet overlaps the restraining members 711 and 712 are outside the recording area. In step S106, the sheet is conveyed to the position where the sheet faces the recording head 50, and recording is started. The sheet on which an image is recorded is conveyed by the sheet ejecting rollers 40 and 41, and is ejected from the apparatus body in step S107. Thus, the recording operation is finished.

Figure 12:
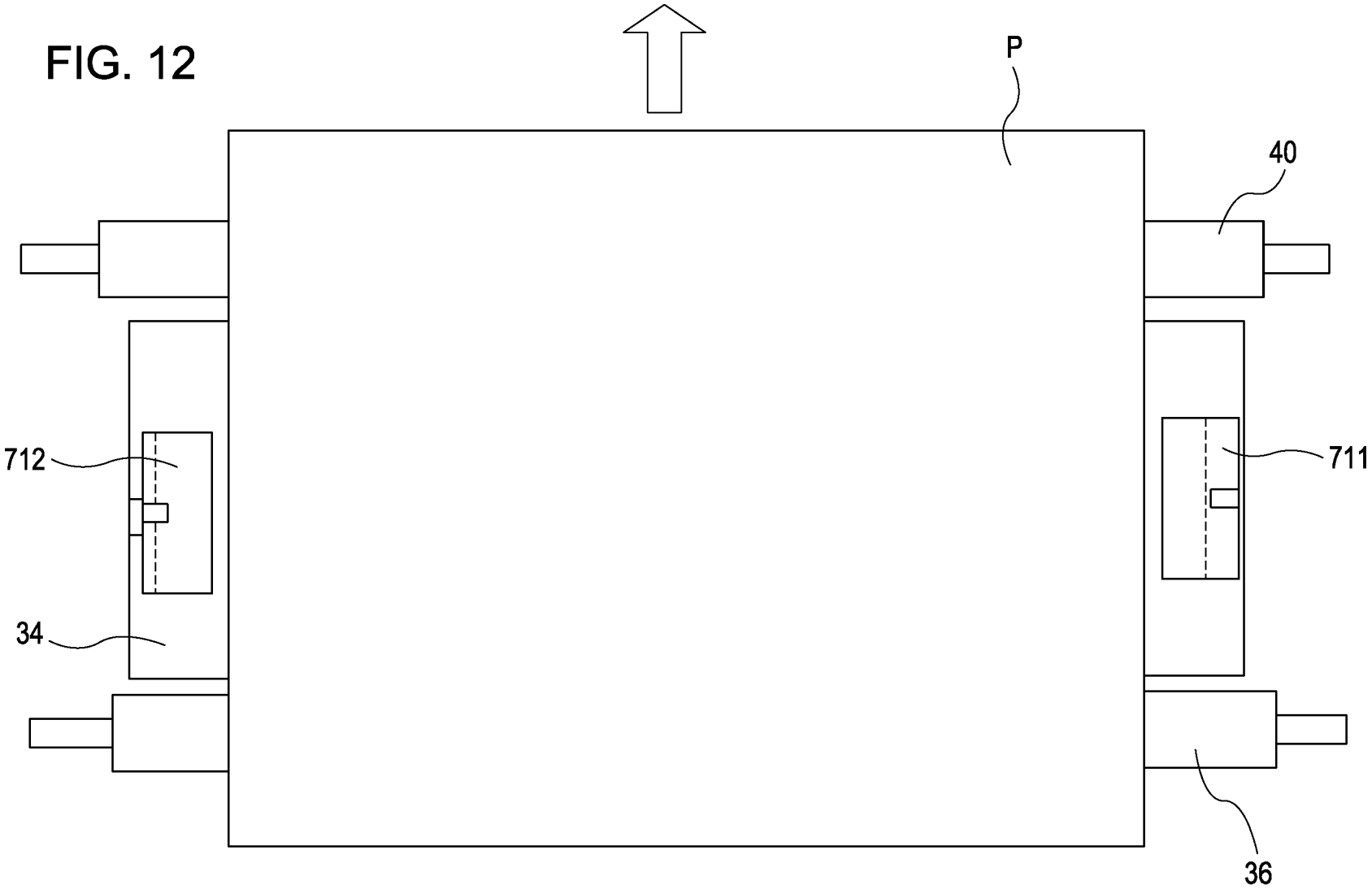
FIG. 12 is a plan view illustrating the state in which the restraining members are moved away from the side edges of the sheet.

FIG. 12 is a plan view illustrating the state in which the restraining members 711 and 712 are moved away from the side edges of the sheet. In the process of both-side recording in which both sides of the sheet is recorded on using the U-turn conveying unit 8A, first, the first side (front side) is recorded on. Then, after the trailing edge of the sheet moves past the restraining members 711 and 712, the conveying roller 36 and the sheet ejecting roller 40 are rotated in the reverse direction, thereby conveying the sheet in the reverse direction on the platen 34. Thus, the sheet is fed to the conveying path of the U-turn conveying unit 8. At this time, if the sheet on which an image is recorded on the first side thereof is curled, there is a possibility that the trailing edge of the sheet cannot be inserted under the restraining surfaces 711*a* and 712*a* of the restraining members 711 and 712, respectively, and the sheet will be jammed.

To prevent this, when the sheet on which an image is recorded on the first side thereof is conveyed in the reverse direction toward the U-turn conveying path in the operation of both-side recording, the restraining members 711 and 712 at are moved away from the side edges of the sheet to standby positions. In such a case, the first restraining member 711 and the second restraining member 712 are both arranged to be movable and are temporarily moved away from the side edges of the sheet P. Also in this process, the restraining members 711 and 712 are moved by the movement of the carriage 55. Thus, the sheet can be reliably prevented from coming into contact with the recording head or becoming jammed also when the sheet is conveyed in the reverse direction during both-side recording.

The restraining members 711 and 712 are also moved outward, as shown in FIG. 12, in the process of borderless recording in which an image is recorded without leaving white spaces along the edges of the sheet. Although sheets of normal paper are thin and can cause a large amount of curl, sheets of special paper as those used in borderless recording are generally thick and are not easily curled. Accordingly, the restraining members 711 and 712 can be used in the operation of normal printing using sheets of normal paper, and the restraining members 711 and 712 can be moved to the standby positions in the operation of borderless recording using sheets of special paper. Thus, the position of each restraining member can be switched in accordance with the kind of the sheet between a sheet-restraining position at which the restraining member is used and a standby position which is separated from the sheet-restraining position and at which the restraining member is not used. When the sheet is conveyed in the reverse direction in the process of both-side recording or when borderless recording is performed, the restraining members 711 and 712 are moved to the standby positions in response to the determination based on recording mode information transmitted from a printer driver. Thus, in the present embodiment, the restraining members are controlled so as to move to the sheet-restraining positions on the basis of the sheet width information obtained by the sheet-width detection sensor 714 and the recording mode information representing borderless recording, both-side recording, etc.

Figure 13:
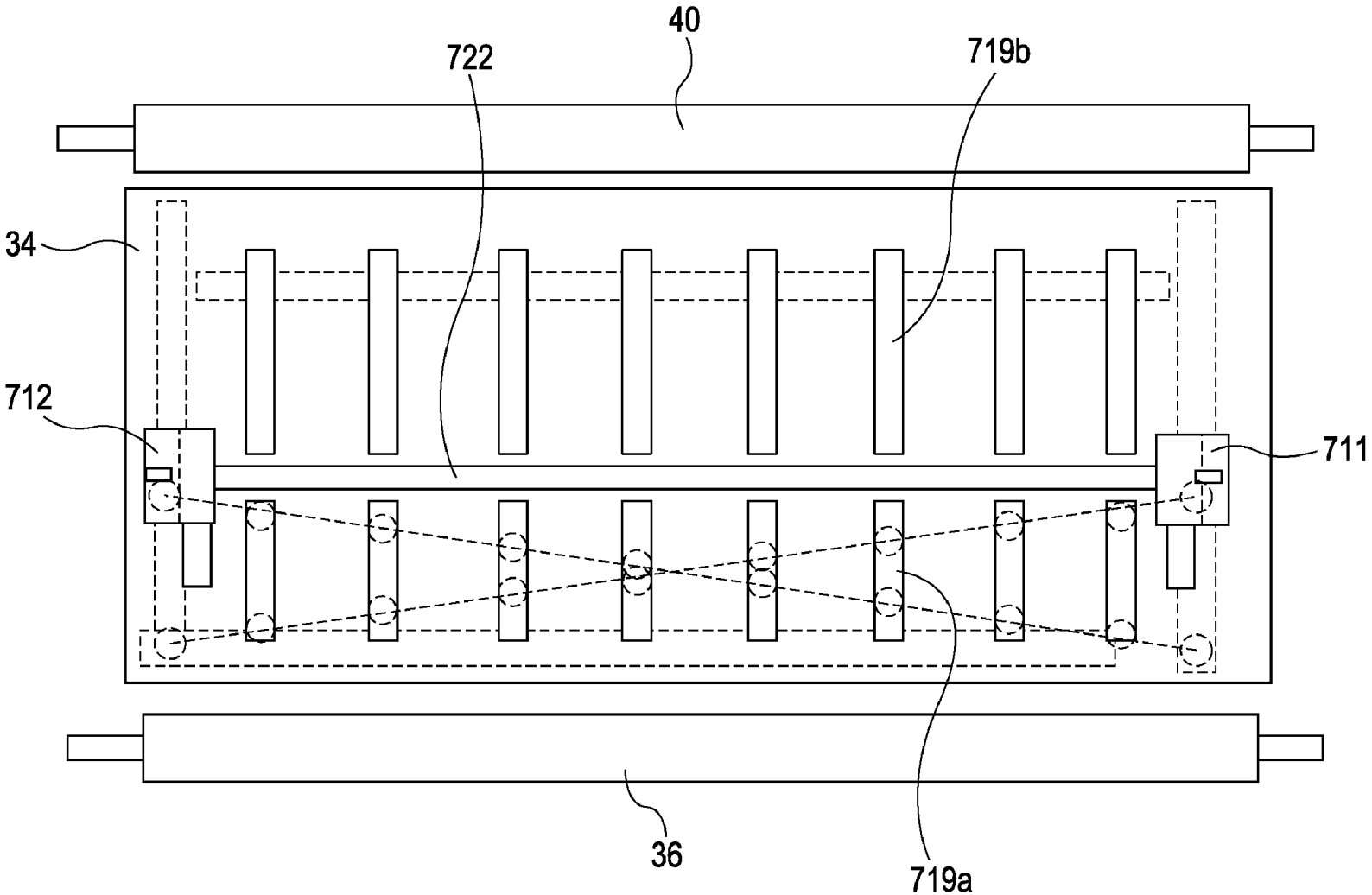
FIG. 13 is a plan view illustrating the state in which ribs provided on a platen are arranged in a large area.
Figure 14:
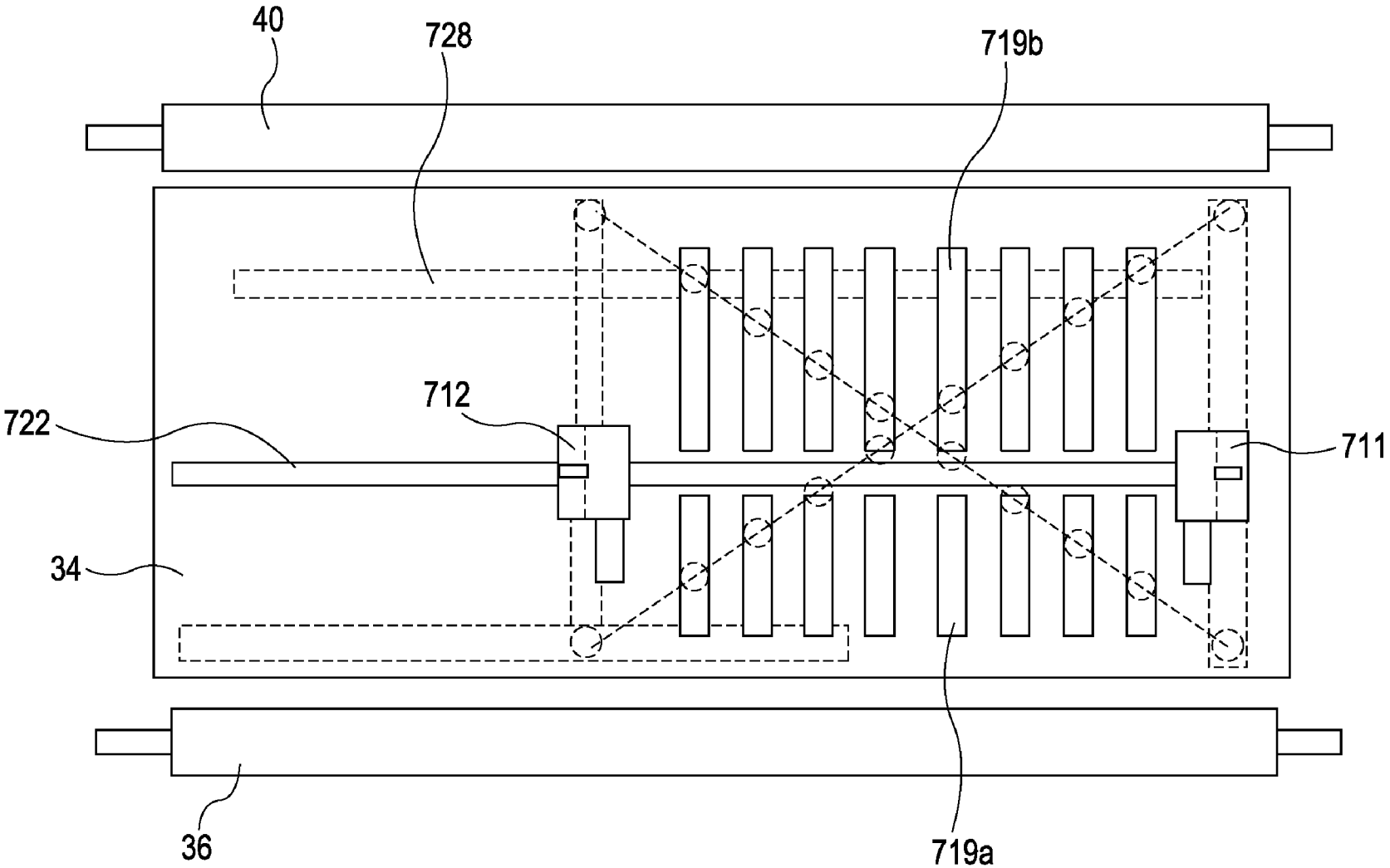
FIG. 14 is a plan view illustrating the state in which the ribs provided on the platen are arranged in a small area.

The ribs 719 for guiding the sheet being conveyed are provided on the platen 34. In the present embodiment, the ribs 719 are configured to be movable in the sheet-width direction in accordance with the movement of the restraining member 712. FIG. 13 is a plan view illustrating the state in which the second restraining member 712 is positioned near an edge of the platen 34 and the ribs 719 are arranged in a relatively large area. FIG. 14 is a plan view illustrating the state in which the second restraining member 712 is positioned near the center of the platen 34 and the ribs 719 are arranged in a relatively small area. Referring to FIGS. 13 and 14, the movement of the second restraining member 712 is transmitted to the ribs 719 by a link unit 726.

Although each rib 719 is shown as if it is divided by the guide rail 722 in FIGS. 13 and 14, each rib 719 has an integral body that extends below the guide rail 722. In other words, each rib 719 has an upstream portion 719*a* and a downstream portion 719*b* positioned upstream and downstream, respectively, of the guide rail 722 in the sheet conveying direction, and the upstream portion 719*a* and the downstream portion 719*b* are integrated with each other. The ribs 719 are capable of sliding along a rail member 728 that extends in the sheet-width direction while the ribs 719 are maintained parallel to each other. Therefore, when the second restraining member 712 is moved by the movement of the carriage 55, the ribs 719 are also moved at the same time. Thus, the same number of ribs are always evenly arranged within the width of the sheet on the platen 34.

Due to the above-described structure, the sheet P being conveyed receives even resistance from the ribs 719. Although the ribs are unevenly arranged in the left-right direction depending on the sheet side in the known structure, the ribs can be evenly arranged irrespective of the sheet size in the present embodiment. As a result, the sheet being conveyed receives even resistance from the platen 34, whereby the difference in the amount of conveyance between left and right sections of each sheet or between sheets having different sizes can be eliminated and each sheet can be conveyed with high accuracy. Consequently, high-quality image recording can be performed. Although one of the side edges of the sheet P is used as a reference in the width direction in the present embodiment, the present invention is not limited to this. For example, the structure of the present embodiment may also be used in recording apparatus in which the center of the sheet in the width direction thereof is used as a reference. Also in this case, effects similar to the above-described effects can be obtained. In this case, the restraining members 711 and 712 are both moved to restraining positions corresponding to the sheet width.

According to the above-described structure, even when the side guide of the sheet-feeding unit is not set at an accurate position or when an accurate sheet size is not set by the printer driver or the like, the sheet being conveyed can be reliably prevented from coming into contact with the recording head or becoming jammed. In addition, recording operation can be performed with high reliability even when sheets of different sizes are stacked in a plurality of sheet-feeding units.

The embodiments of the present invention provide a recording apparatus capable of preventing a recording sheet from coming into contact with a recording head or becoming jammed irrespective of the state in which the recording sheet is set in a sheet-feeding unit.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-118156 filed Apr. 27, 2007, which is hereby incorporated by reference herein in its entirety.

What is claimed is:

1. A recording apparatus that performs recording on a sheet using a recording head, the recording apparatus comprising:

a carriage moved by a carriage motor for carrying the recording head;

a guide member configured to guide the sheet at a position where the guide member faces the recording head;

a restraining member arranged on the guide member and configured to restrain a side edge of the sheet from being raised;

an information obtaining unit for obtaining information about a position of the side edge in a moving direction of the carriage of the sheet that is conveyed; and a connecting unit for connecting the carriage and the restraining member so that the restraining member is moved by the carriage motor with the carriage, wherein the restraining member is moved in accordance with the information about the position of the side edge of the sheet, and wherein the carriage separates from the restraining member when recording by the recording head is performed.

2. The recording apparatus according to claim 1, wherein the side edge detector, the restraining member, and the recording head are arranged in that order from an upstream in a direction in which the sheet is conveyed.

3. The recording apparatus according to claim 1, wherein the guide member includes a plurality of ribs guiding the sheet that is conveyed, the ribs being moved in accordance with the movement of the restraining member.

4. The recording apparatus according to claim 1, wherein, when borderless recording is performed by the recording head, the restraining member is moved to a standby position from the position at which the restraining member restrains the side edge of the sheet.

5. The recording apparatus according to claim 1, wherein, when both-side recording is performed by the recording head and when the sheet is conveyed in a reverse direction after a first side of the sheet is recorded on, the restraining member is moved to a standby position from the position at which the restraining member restrains the side edge of the sheet.

6. The recording apparatus according to claim 1, wherein the position of the restraining member is switched, in accordance with the kind of the sheet, between the position at which the restraining member restrains the side edge of the sheet and a standby position separated from the position at which the restraining member restrains the side edge of the sheet.

7. The recording apparatus according to claim 1, wherein during a recording operation by the recording head, connection between the carriage and the restraining member by the connecting unit is canceled so that the carriage is separated from the restraining member.

* * * * *